US007500516B2

(12) United States Patent
Borak

(10) Patent No.: US 7,500,516 B2
(45) Date of Patent: Mar. 10, 2009

(54) SYSTEM, METHOD, AND APPARATUS FOR ACCESSING OUTLETS IN A TWO-STAGE DIVERTER SPOOL ASSEMBLY

(75) Inventor: Eugene A. Borak, Cypress, TX (US)

(73) Assignee: Vetco Gray Inc., Houston, TX (US)

( * ) Notice: Subject to any disclaimer, the term of this patent is extended or adjusted under 35 U.S.C. 154(b) by 284 days.

(21) Appl. No.: 11/244,643

(22) Filed: Oct. 6, 2005

(65) Prior Publication Data

US 2007/0079990 A1 Apr. 12, 2007

(51) Int. Cl.
*E21B 34/14* (2006.01)
*E21B 33/06* (2006.01)

(52) U.S. Cl. ..... 166/85.4; 166/386; 251/1.1

(58) Field of Classification Search ..... 166/85.3, 166/85.4, 97.1, 379, 386, 91.1, 95.1, 285; 175/57, 211, 214; 251/1.1
See application file for complete search history.

(56) References Cited

U.S. PATENT DOCUMENTS 2,157,496 A * 5/1939 Penick et al. ..... 285/123.8
2,330,267 A * 9/1943 Burt et al. ..... 137/71
2,370,833 A * 3/1945 Baker ..... 166/153
2,379,079 A * 6/1945 Hayward ..... 166/154
2,889,886 A * 6/1959 Gould ..... 166/89.3
RE25,415 E * 7/1963 Merritt et al. ..... 172/9
4,513,823 A * 4/1985 Hynes et al. ..... 166/386
4,648,445 A * 3/1987 Caskey ..... 166/98
4,674,569 A * 6/1987 Revils et al. ..... 166/154
4,848,024 A * 7/1989 Hanson ..... 43/44.82
4,850,432 A * 7/1989 Porter et al. ..... 166/373
5,117,910 A * 6/1992 Brandell et al. ..... 166/291
5,211,228 A * 5/1993 Watkins ..... 166/84.1
5,890,535 A * 4/1999 Petrash et al. ..... 166/88.1
6,453,995 B2 * 9/2002 Gatherar et al. ..... 166/75.14
6,712,147 B2 * 3/2004 Dallas ..... 166/379
7,237,611 B2 * 7/2007 Vincent et al. ..... 166/285
2004/0154839 A1 * 8/2004 McGarian et al. ..... 175/324

* cited by examiner

*Primary Examiner*—Jennifer H Gay
*Assistant Examiner*—Sean D Andrish
(74) *Attorney, Agent, or Firm*—Bracewell & Giuliani

(57) ABSTRACT

A wellhead system diverter spool contains an internal sleeve that can be axially shifted internal to the spool with a handling tool. The sleeve permits access to outlets in the spool when required. When higher pressures are required, the internal sleeve is shifted downward to close off access to the outlets without change out of equipment or changing the BOP stack riser system. The low pressure lines connected to the outlets can remain installed but are isolated from the higher pressure BOP stack pressures.

26 Claims, 5 Drawing Sheets

23
61
63
59
42
45
43
51
53
41
42
55
25
57
49
27
47

SYSTEM, METHOD, AND APPARATUS FOR ACCESSING OUTLETS IN A TWO-STAGE DIVERTER SPOOL ASSEMBLY

BACKGROUND OF THE INVENTION

1. Technical Field

The present invention relates in general to diverter spools and, in particular, to an improved system, method, and apparatus for selectively opening and closing low pressure or uncontrolled outlets in two-stage diverter spools.

2. Description of the Related Art

Diverters are mounted to drilling rigs below the rig floor for use throughout the various stages of drilling. A support housing typically mounts below the rig floor and has a lateral flowline outlet for directing mud flow. The housing is a tubular member with an axial bore. A diverter body is secured to the upper end of a riser, is lowered through the rotary table, and lands in the housing. The diverter body has lateral flow openings that are axially aligned with the lateral flowline outlet. A pair of seals are usually located above and below the lateral flowline outlet.

The mud flow outlets are limited to low pressure or uncontrolled applications and are incapable of handling higher pressures associated with blow out preventers (BOPs). During standard operations, the mud flow is typically no more than a hydrostatic head pressure. When the BOP is located above the low pressure outlets, the diverter must be removed from the wellhead assembly prior to permitting high pressure flow through the assembly to the surface. Unfortunately, the down time and cost associated with the removal of the diverter can be significant. Thus, although prior art designs are workable, an improved design that overcomes the shortcomings of the prior art would be desirable.

SUMMARY OF THE INVENTION

One embodiment of a system, method, and apparatus for selectively opening and closing outlets in two-stage diverter spools is disclosed. The present invention forms a portion of a wellhead system having an upper diverter, a BOP, a lower diverter, and a wellhead housing assembly therebelow. The lower diverter has an axial bore and one or more outlets or "low pressure" outlets. A sleeve is located in and axially movable relative to the lower diverter. The sleeve has an open position wherein access to the low pressure outlets is unimpeded, and a closed position for impeding access to the low pressure outlets.

A handling tool is used to manipulate the position of the sleeve. The handling tool has pins for moving the sleeve between the open and closed positions. The handling tool also has a locator sleeve for locating an axial position of the handling tool relative to the sleeve. The locator sleeve has a lower position for locating the handling tool at the upper end of the sleeve to push the sleeve down to the closed position. The locator sleeve also has an upper position for locating the handling tool at the lower end of the sleeve to pull the sleeve upward to the open position.

In one embodiment, the outlets on the two-stage diverter spool allow for cuttings/mud flow to be diverted to the mud pits without passing them through the BOP stack. These outlets are used, for example, when drilling through formations that do not require BOP control. The two-stage diverter spool allows for the wellhead, riser, and BOP stack to be installed at one time to save rig time operations.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
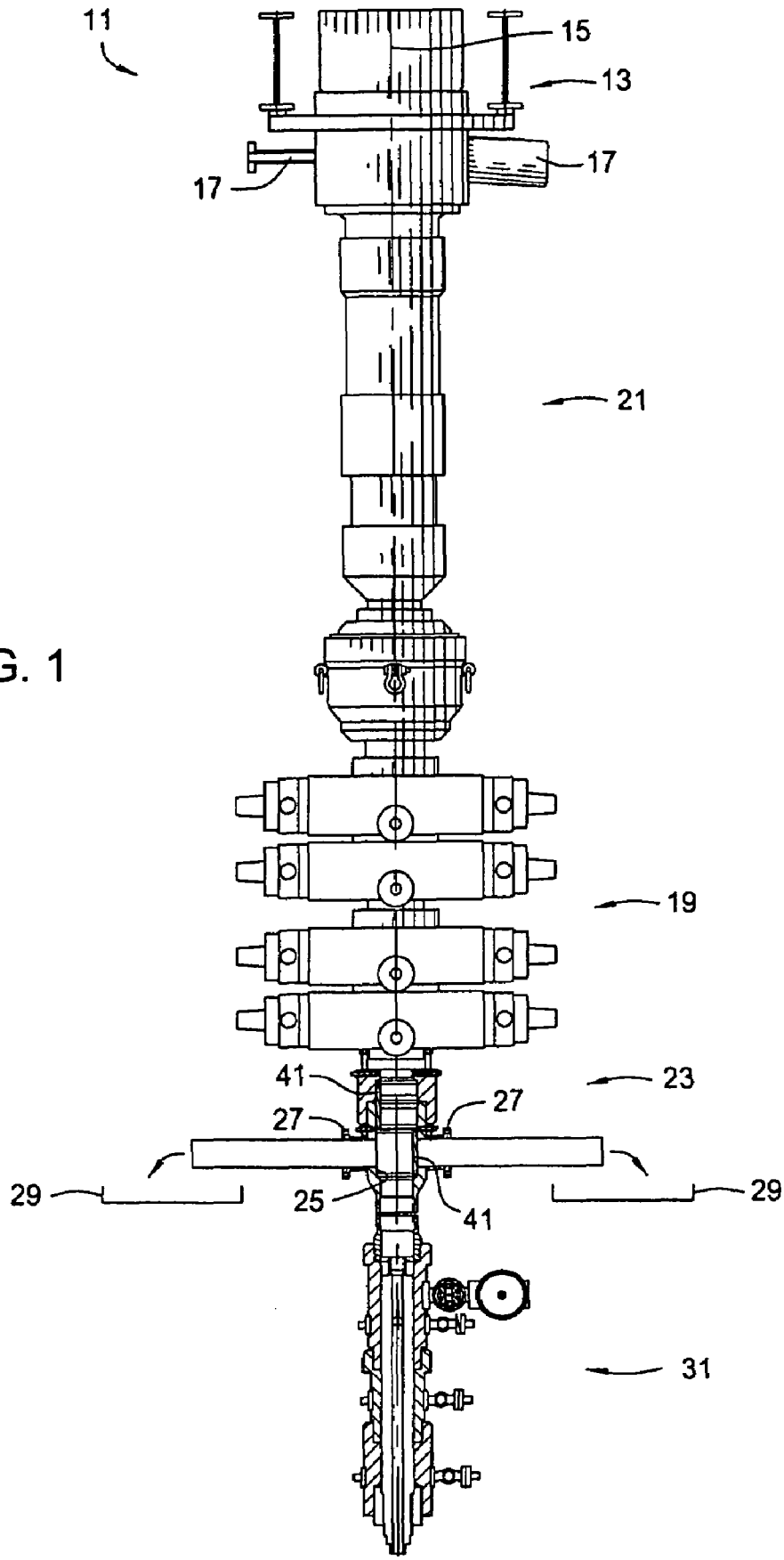
FIG. 1 is a sectional side view of one embodiment of a wellhead system showing, on the left, a diverter sleeve in an open position and, on the right, the diverter sleeve in a closed position, and is constructed in accordance with the present invention.
Figure 2:
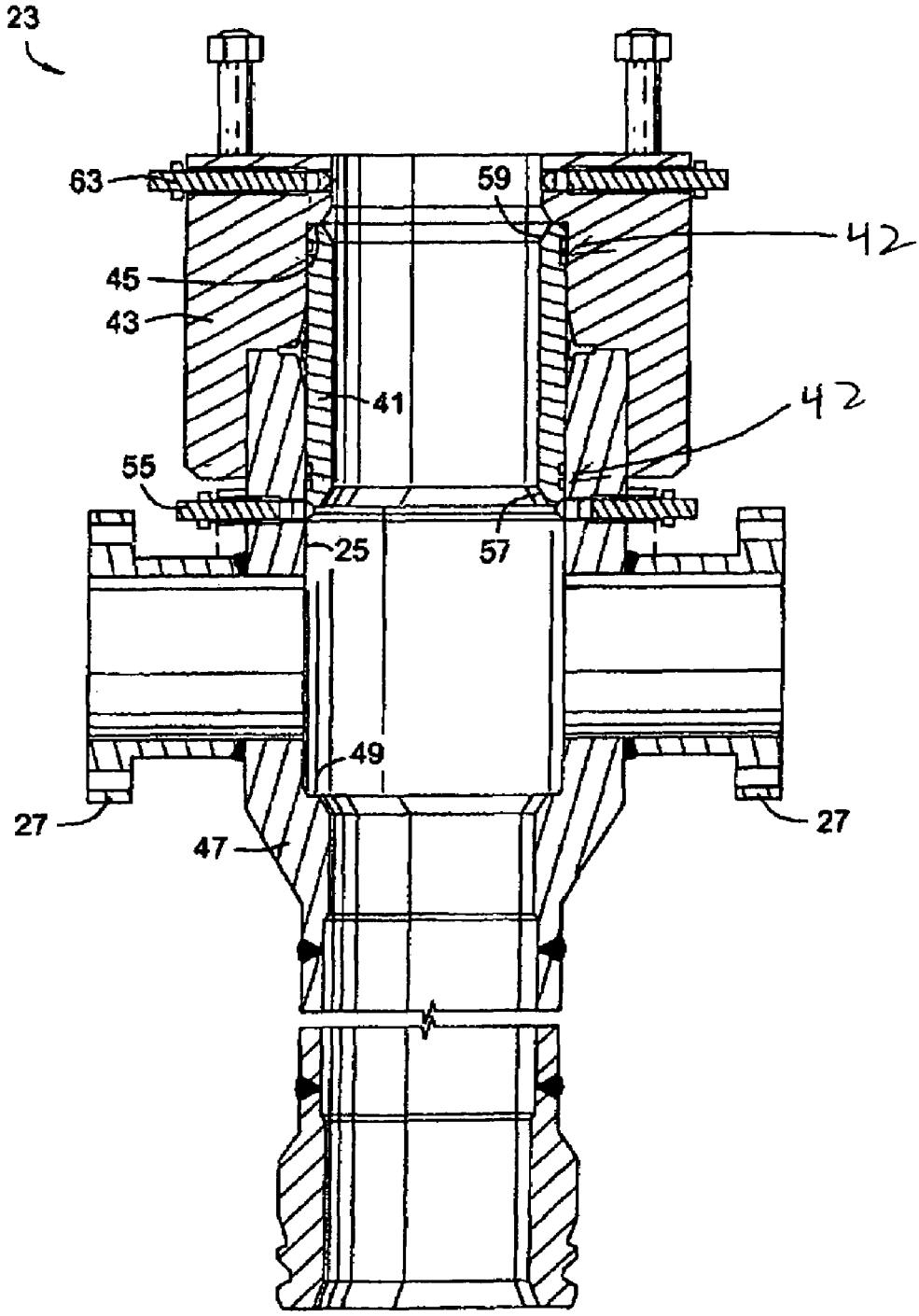
FIG. 2 is an enlarged sectional side view of a diverter spool flow tee assembly in the wellhead system of FIG. 1, showing the diverter sleeve in the open position.
Figure 3:
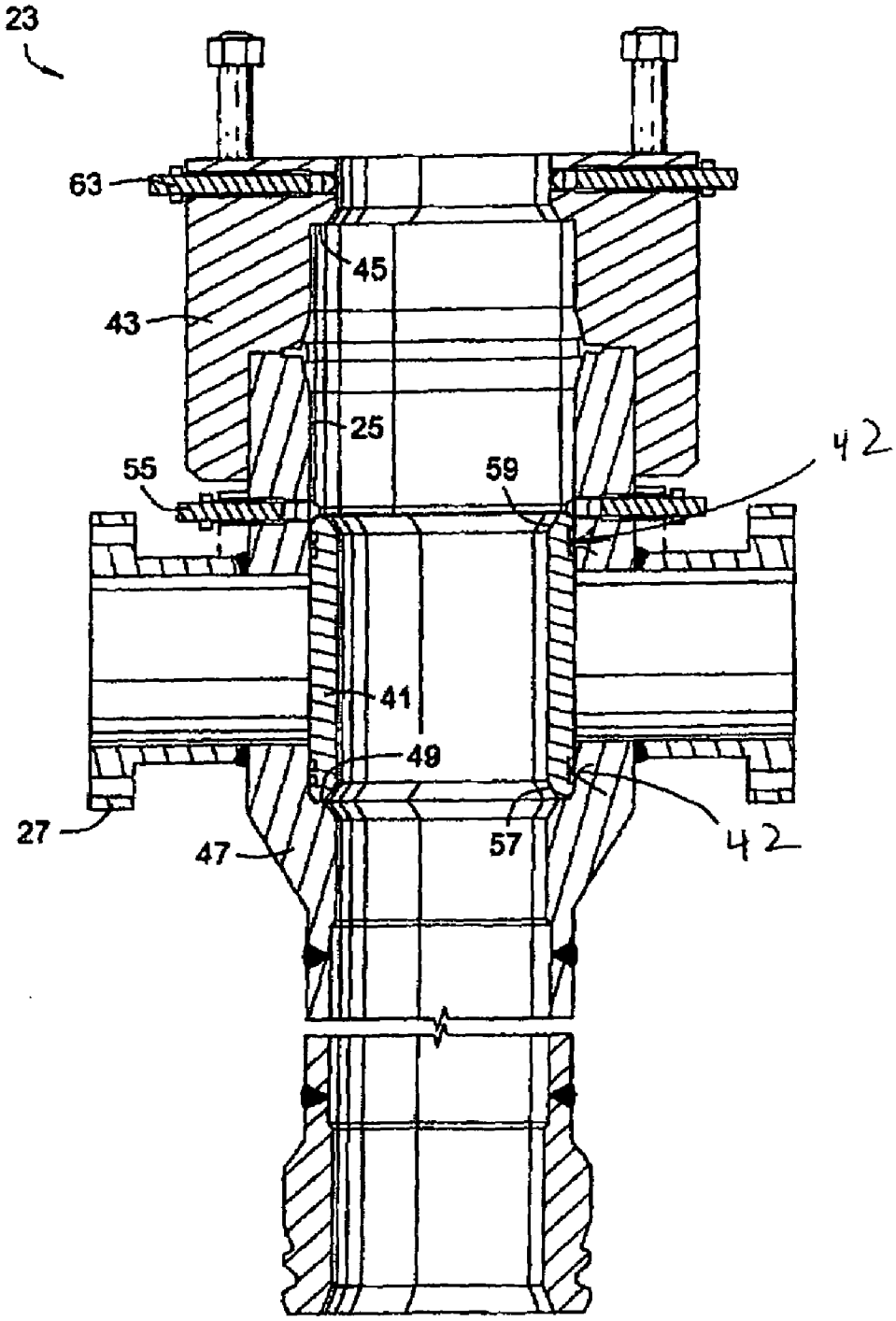
FIG. 3 is a sectional side view of the diverter spool flow tee assembly of FIG. 2, showing the diverter sleeve in the closed position.

Referring to FIGS. 1-5, one embodiment of an improved system, method, and apparatus for selectively opening and closing outlets or "low pressure" outlets in two-stage diverter spools is shown. FIG. 1 depicts a wellhead system 11 comprising an upper diverter 13 having an axis 15 and additional or "high pressure" outlets 17. A blowout preventer, or BOP 19, is mounted axially below the upper diverter 13. An optional overshot mandrel 21 is located between the upper diverter 13 and the BOP 19. A lower diverter 23 is mounted axially below the BOP 19. The lower diverter 23 has an axial bore 25 and low pressure outlets 27 extending from the axial bore 25 to mud pits 29 for discharging drilling mud therefrom. A wellhead housing assembly 31 is mounted axially below the lower diverter 23.

Referring now to FIGS. 2-5, a sleeve 41 is located in and axially movable relative to the axial bore 25 of the lower diverter 23. The sleeve 41 has an open position (left side of FIG. 1 and FIGS. 2 and 4) wherein access to the low pressure outlets 27 is unimpeded. The sleeve 41 also has a closed position (right side of FIG. 1 and FIGS. 3 and 5) for impeding access to the low pressure outlets 27. A seal 42 is located on an exterior surface of the sleeve 41 for sealing the low pressure outlets 27 when the sleeve is in the closed position. The lower diverter 23 remains installed in the wellhead system 11 when the sleeve 41 is in both the open and closed positions.

In one embodiment, the lower diverter 23 comprises a drilling adapter 43 having an upper axial shoulder 45 for landing the sleeve 41 in the open position. The lower diverter 23 also may comprise a body 47 secured to the drilling adapter 43. The body 47 is secured to a lower end of the drilling adapter 43 and has an axial bore 25 that is concentric with the axial bore 25 of the drilling adapter 43. The body 47 also has a lower axial shoulder 49 for landing the sleeve 41 in the closed position. The low pressure outlets 27 extend through the body 47. In the version illustrated, the sleeve 41 axially straddles the drilling adapter 43 and the body 47 in the open position, and the sleeve 41 is axially located entirely within the body 47 in the closed position.

Figure 4:
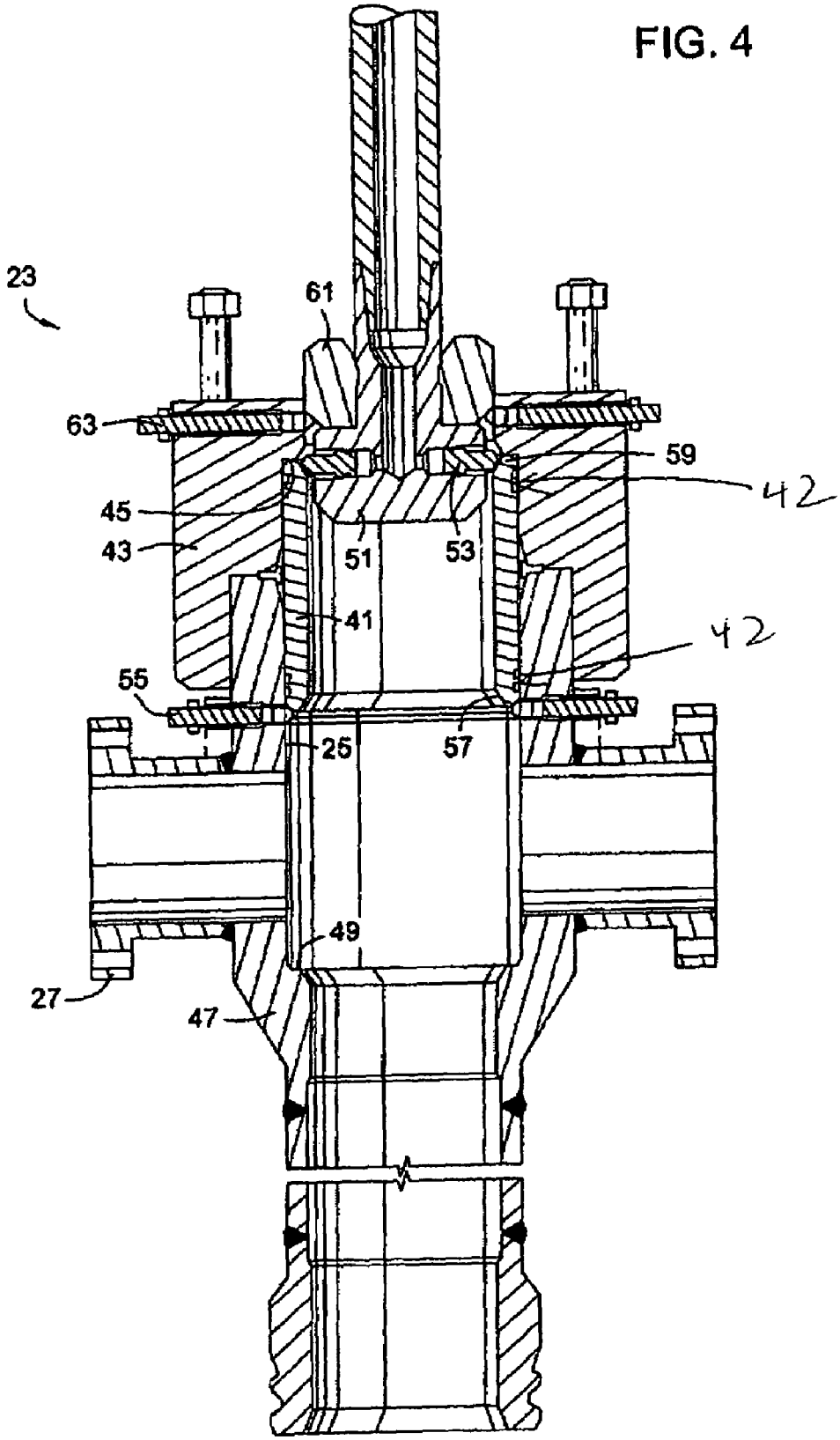
FIG. 4 is a sectional side view of the diverter spool flow tee assembly of FIG. 2, with the diverter sleeve in the open position, and shown with a handling tool.
Figure 5:
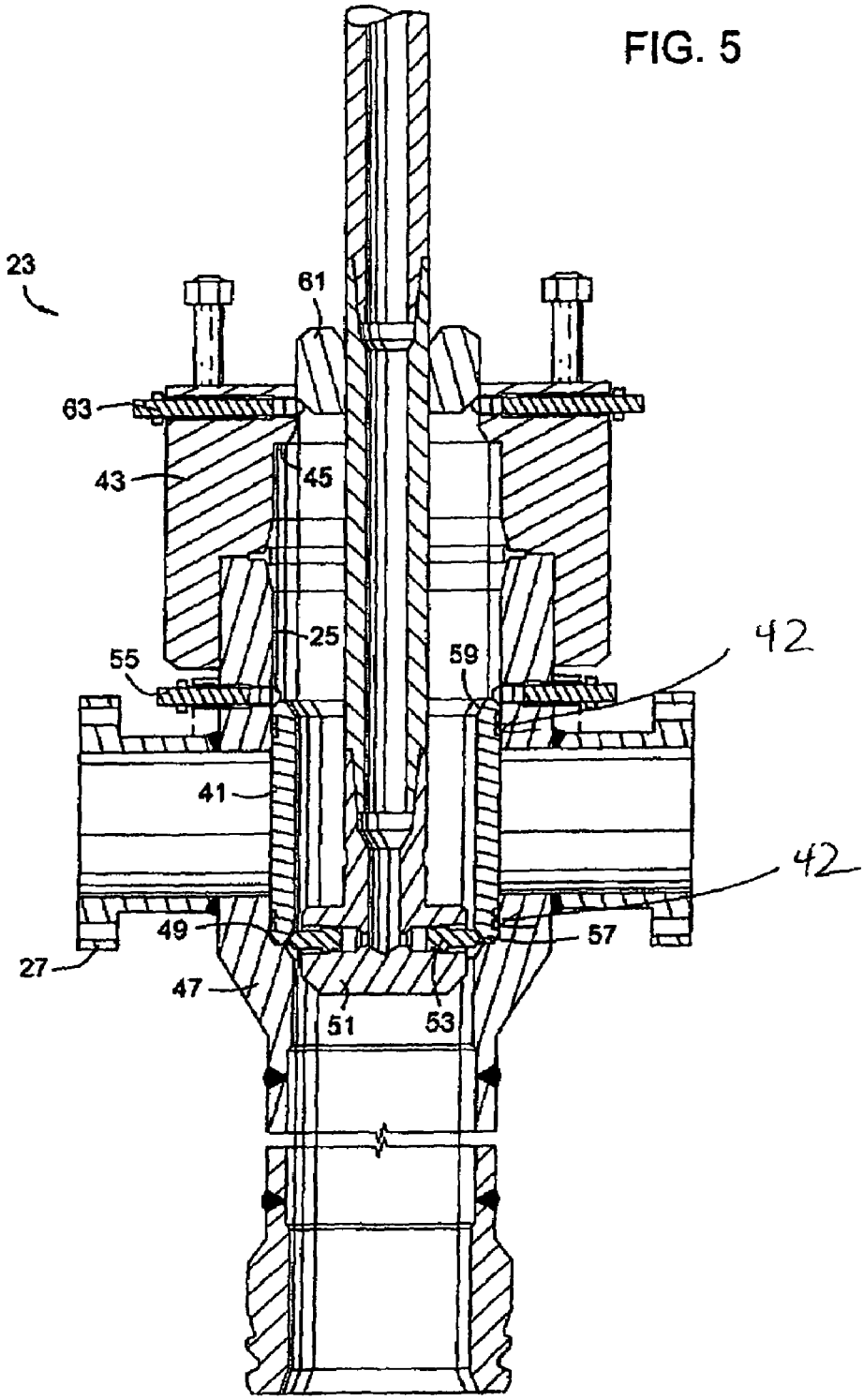
FIG. 5 is a sectional side view of the diverter spool flow tee assembly and handling tool of FIG. 4, with the diverter sleeve in the closed position.

Referring now to FIGS. 4 and 5, a handling tool 51 is used to manipulate the position of the sleeve 41. Since the lower diverter 23 remains installed in the wellhead assembly 11, the handling tool 51 extends through the upper diverter 13 and the BOP 19 for moving the sleeve 41 between the open and closed positions. The handling tool 51 has a plurality of hydraulically-actuated, radially movable pins 53 for engaging and disengaging the sleeve 41 for moving the sleeve 41 between the open and closed positions. The lower diverter 23 (e.g., the body 47) has a plurality of radially movable sleeve retainer screws 55 for engaging and securing the lower end 57 of the sleeve 41 in the open position. Screws 55 also engage and secure an upper end 59 of the sleeve 41 in the closed position.

In addition, the handling tool 51 has a locator sleeve 61 mounted thereto, and the lower diverter 23 (e.g., drilling adapter 43) has locator screws 63 for engaging the locator sleeve 61 for locating an axial position of the handling tool 51 relative to the sleeve 41. The locator sleeve 61 is axially movable relative to the handling tool 51. The locator sleeve 61 has a lower position (FIG. 4) for locating the handling tool 51 at the upper end 59 of the sleeve 41 to push the sleeve 41 down to the closed position. The locator sleeve 61 also has an upper position (FIG. 5) for locating the handling tool 51 at the lower end 57 of the sleeve 41 to pull the sleeve 41 upward to the open position.

The present invention also comprises a method of controlling discharge of drilling mud in a wellhead system. In one embodiment, the method includes the steps of providing a wellhead system 11 with an upper diverter 13 having an axis 15 and high pressure outlets 17, a BOP 19, a lower diverter 23 mounted axially below the BOP 19, and a wellhead housing assembly 31 mounted axially below the lower diverter 23; equipping the lower diverter 23 with an axial bore 25 and low pressure outlets 27 extending from the axial bore 25, and discharging drilling mud from the low pressure outlets 27 to mud pits 29; positioning a sleeve 41 in the lower diverter 23 in an open position such that access to the low pressure outlets 27 is unimpeded; and moving the sleeve 41 to a closed position for impeding access to the low pressure outlets 27, such that the lower diverter 23 remains installed in the wellhead system 11 when the sleeve 41 is in both the open and closed positions.

The method also may comprise landing the sleeve 41 on an upper axial shoulder 45 in the lower diverter 23, and landing the sleeve 41 on a lower axial shoulder 49 in the lower diverter 23. The method may further comprise extending a handling tool 61 through the upper diverter 13 and the BOP 19 while moving the sleeve 41 between the open and closed positions; and/or engaging and disengaging the sleeve 41 with hydraulically-actuated, radially movable pins 53 on the handling tool 51 to move the sleeve 41 between the open and closed positions; and/or engaging and disengaging a lower end 57 of the sleeve 41 with radially movable sleeve retainer screws 55 on the lower diverter 23 in the open position, and engaging and securing an upper end 59 of the sleeve 41 with the retainer screws 55 in the closed position.

In addition, the method may further comprise providing a locator sleeve 61 on the handling tool 51, and locator screws 63 on the lower diverter 23 for engaging the locator sleeve 61, and locating an axial position of the handling tool 51 relative to the sleeve 41 with the locator sleeve 61 and locator screws 63; and/or axially moving the locator sleeve 61 relative to the handling tool 51, such that the locator sleeve 61 has a lower position for locating the handling tool 51 at an upper end 59 of the sleeve 41 to push the sleeve 41 down to the closed position, and an upper position for locating the handling tool 51 at a lower end 57 of the sleeve 41 to pull the sleeve 41 upward to the open position.

The present invention has several advantages, including the ability to axial shift the sleeve internal to the spool with a handling tool. The sleeve permits access to low pressure outlets in the spool when required. When higher pressures are required, the internal sleeve is shifted downward to close off access to the low pressure outlets without change out of equipment or changing the BOP stack riser system. The low pressure lines connected to the low pressure outlets can remain installed but are isolated from the higher pressure BOP stack pressures.

While the invention has been shown or described in only some of its forms, it should be apparent to those skilled in the art that it is not so limited, but is susceptible to various changes without departing from the scope of the invention.

What is claimed is:

1. A wellhead system, comprising:

a lower diverter adapted to be disposed in a wellhead system between a blowout preventer (BOP) and a wellhead housing assembly, the lower diverter having an axial bore and a pressure outlet extending from the axial bore for discharging drilling mud therefrom, the lower diverter comprising:

a sleeve located in and axially movable relative to the axial bore, the sleeve having an upward axial position and a downward axial position, wherein access from the axial bore to the pressure outlet is unimpeded when the sleeve is disposed in the upward axial position; and a sleeve retainer screw to secure the sleeve in the upward axial position.

2. A wellhead system according to claim 1, wherein the lower diverter comprises a drilling adapter having an upper axial shoulder for landing the sleeve in the upward axial position, a body secured to the drilling adapter and having a lower axial shoulder for landing the sleeve in the downward axial position, and the pressure outlet extends through the body.

3. A welthead system according to claim 2, wherein the sleeve actually straddles the drilling adapter and the body in the upward axial position, and the sleeve is axially located entirely within the body in the downward axial position.

4. A wellhead system according to claim 1, further comprising an overshot mandrel located between an upper diverter and the BOP.

5. A wellhead system according to claim 1, further comprising a handing tool adapted to extend through an upper diverter and the BOP for moving the sleeve between the upward axial and downward axial positions.

6. A wellhead system according to claim 1, wherein the sleeve retainer screw comprises at least one radially movable sleeve retainer screw for engaging and securing a lower end of the sleeve in the upward axial position of the sleeve, and engaging and securing an upper end of the sleeve in the downward axial position of the sleeve.

7. A wellhead system according to claim 1, wherein the lower diverter comprises locator screws for engaging a locator sleeve for locating an axial position of a handling tool relative to the sleeve, the handling tool being adapted to extend through the BOP to move the sleeve between the upward axial position and the downward axial position.

8. A wellhead system according to claim 5, wherein the handling tool comprises a locator sleeve, the locator sleeve being axially movable along a portion of the handling tool, the locator sleeve having a lower position for locating the handling tool at an upper end of the sleeve to push the sleeve down to the downward axial position, and an upper position for locating the handling tool at a lower end of the sleeve to pull the sleeve upward to an open position.

9. A wellhead system according to claim 1, wherein access from the axial bore to the pressure outlet is unimpeded when the sleeve is in the upward axial position and access from the axial bore to the pressure outlet is impeded when the sleeve is in the downward axial position.

10. A diverter for a wellhead system, comprising:

a drilling adapter having an axial bore, and an upper axial shoulder in the axial bore;

a body securable to a lower end of the drilling adapter and having an axial bore concentric with the axial bore of the drilling adapter, a lower axial shoulder formed in the axial bore of the body, and low pressure outlets extending radially through the body;

a sleeve located in and axially movable relative to the axial bores of the drilling adapter and the body, the sleeve landing on the upper axial shoulder in an open position such that access to the low pressure outlets is unimpeded, and the sleeve landing on the lower axial shoulder in a closed position for impeding access to the low pressure outlets; and a sleeve locking system for mechanically locking the sleeve in the closed position.

11. A diverter according to claim 10, wherein the sleeve axially straddles the drilling adapter and the body in the open position, and the sleeve is axially located entirely within the body in the closed position.

12. A diverter according to claim 10, further comprising a handling tool for moving the sleeve between the open and closed positions.

13. A diverter according to claim 10, wherein the sleeve locking system comprises a plurality of radially movable sleeve retainer screws for engaging and securing an upper end of the sleeve in the closed position.

14. A diverter according to claim 10, wherein the drilling adapter comprises locator screws extending radially therethrough for engaging a locator sleeve for locating an axial position of a handling tool relative to the sleeve, the handling tool being adapted to extend through the BOP to move the sleeve between the open position and the closed position.

15. A diverter according to claim 12, wherein the handling tool comprises a locator sleeve, the locator sleeve is being axially movable along a portion of the handling tool, the locator sleeve having a lower position for locating the handling tool at an upper end of the sleeve to push the sleeve down to the closed position, and an upper position for locating the handling tool at a lower end of the sleeve to pull the sleeve upward to the open position.

16. A method of controlling discharge of drilling mud in a wellhead system, the method comprising:

assembling a wellhead system with a lower diverter having an axial bore and an outlet mounted axially in the wellhead system below an upper diverter and a blowout preventer (BOP) and above a wellhead housing assembly;

positioning a sleeve in the lower diverter in an open position to enable drilling mud to be discharged from the axial bore through the outlet;

positioning the sleeve in a closed position to block drilling mud from being discharged from the axial bore through the outlet; and mechanically securing the sleeve in the closed position to prevent the sleeve from being repositioned from the closed position to the open position.

17. A method according to claim 16, wherein positioning the sleeve in the lower diverter in the open position comprises landing the sleeve on an upper axial shoulder in the lower diverter, and positioning the sleeve in the closed position comprises landing the sleeve on a lower axial shoulder in the lower diverter.

18. A method according to claim 16, further comprising extending a handling tool through the upper diverter and the BOP to move the sleeve between the open and closed positions.

19. A method according to claim 18, further comprising engaging and disengaging the sleeve with hydraulically-actuated, radially movable pins on the handling tool to move the sleeve between the open and closed positions.

20. A method according to claim 18, further comprising engaging and disengaging a lower end of the sleeve with radially movable sleeve retainer screws on the lower diverter in the open position, and engaging and securing an upper end of the sleeve with the retainer screws in the closed position.

21. A method according to claim 18, further comprising providing a locator sleeve on the handling tool, and locator screws on the lower diverter for engaging the locator sleeve, and locating an axial position of the handling tool relative to the sleeve with the locator sleeve and locator screws.

22. A method according to claim 21, further comprising axially moving the locator sleeve relative to the handling tool, such that the locator sleeve has a lower position for locating the handling tool at an upper end of the sleeve to push the sleeve down to the closed position, and an upper position for locating the handling tool at a lower end of the sleeve to pull the sleeve upward to the open position.

23. A wellhead system according to claim 1, comprising: a sleeve retainer screw to secure the sleeve in the downward axial position.

24. A method of controlling discharge of drilling mud in a wellhead system, the method comprising:

assembling a wellhead system with a lower diverter having an axial bore and an outlet mounted axially in the wellhead system below a blowout preventer (BOP) and above a wellhead housing assembly;

positioning a sleeve in the lower diverter in an open position to enable drilling mud to be discharged from the axial bore through the outlet; and mechanically securing the sleeve in the open position to prevent the sleeve from being repositioned from the open position to a closed position that blocks drilling mud from being discharged from the axial bore through the outlet.

25. A method according to claim 24, further comprising:

releasing the sleeve to enable the sleeve to be repositioned from the open position; and repositioning the sleeve from the open position to the closed position to block drilling mud from being discharged from the axial bore through the outlet.

26. A method according to claim 25, further comprising:

mechanically securing the sleeve in the closed position to prevent the sleeve from being repositioned from the closed position to the open position.

* * * * *